United States Patent [19]

Justus

[11] 4,153,504

[45] May 8, 1979

[54] TWIN-WIRE FIBROUS WEB FORMER AND METHOD

[75] Inventor: Edgar J. Justus, Beloit, Wis.

[73] Assignee: Beloit Corporation, Beloit, Wis.

[21] Appl. No.: 764,445

[22] Filed: Jan. 31, 1977

[51] Int. Cl.[2] ..... D21F 1/40; D21F 2/00; D21H 1/06

[52] U.S. Cl. ..... 162/133; 162/190; 162/203; 162/264; 162/301; 162/304; 162/306; 162/DIG. 7

[58] Field of Search ..... 162/133, 190, 203, 264, 162/301, 304, 306, 318, DIG. 7, 300

[56] References Cited

U.S. PATENT DOCUMENTS

| | | | |
|---|---|---|---|
| 2,958,379 | 11/1960 | Hornbostel | 162/318 |
| 3,056,719 | 10/1962 | Webster | 162/203 |
| 3,132,990 | 5/1964 | Trufitt | 162/318 X |
| 3,236,724 | 2/1966 | Wahlstrom | 162/203 X |
| 3,681,193 | 8/1972 | Nykopp | 162/304 |
| 3,876,498 | 4/1975 | Justus | 162/301 X |
| 3,970,514 | 7/1976 | Nykopp | 162/318 X |
| 4,004,968 | 1/1977 | Braun et al. | 162/304 X |

*Primary Examiner*—Richard V. Fisher
*Attorney, Agent, or Firm*—Hill, Gross, Simpson, Van Santen, Steadman, Chiara & Simpson

[57] ABSTRACT

A fibrous web is continuously formed between inner and outer endless foraminous forming belts between which stock slurry is fed from a headbox, the belts being held in tension as they wrap a first convexly curved forming run surface from which the outer belt is separated immediately following the forming run, the inner belt carrying the wet web then running over a second convexly curved surface from the offrunning side of which the inner belt is then separated and a porous pickoff belt is pressed by a substantial convex area of an imperforate pickup roll against the wet web on the inner belt, the inner belt being guided to diverge from the pickoff belt commencing at the off-running end of the convex area of contact of the pickup roll and the wet web being forced to adhere to the pickoff belt by the vacuum action of the imperforate surface of the pickup roll. By multiplication of the apparatus a multiply web can be formed. Either top delivery or bottom delivery of the wet formed web to the pickoff belt is provided for.

19 Claims, 4 Drawing Figures

TWIN-WIRE FIBROUS WEB FORMER AND METHOD

BACKGROUND OF THE INVENTION

This invention relates to improvements in fibrous web formation wherein an aqueous fibrous suspension is dewatered on a forming surface to provide a web which may be further processed into a single ply web or may be joined while wet with additional wet webs to form a multilayer web. More particularly, the invention relates to improvements in web forming apparatus of the type known in the art as twin wire formers wherein a slurry of fibrous stock is delivered from a head-box slice opening to a forming throat between a pair of endless travelling forming wires between which the web is dewatered by being squeezed between the forming wires which are often more generically referred to as forming belts.

Within recent times the art of papermaking has undergone a number of significant advances in web formation using two opposed forming belt runs for web formation therebetween as contrasted to the more conventional Fourdrinier type papermaking machine employing only a single forming wire. The twin belt forming machines have met with substantial commercial success since they offer advantages of requiring less space and improved dewatering at high speeds. As the speed of the papermaking machines has increased, it has become increasingly difficult to handle and control the high speed travelling fibrous web and to determine with a certainty the continued position of the web and to insure that it will follow the desired forming or carrying belt. In the manufacture of lightweight paper webs, such as tissue, it is increasingly difficult to insure that the paper not be damaged at the point of wire separation due to splitting of the web at that point and the problem is one of insuring that most of the fiber will follow one or the other of the forming or carrying wires or belts. These problems are particularly present in apparatus adapted for multi-ply web formation.

Efforts to solve the problems have resulted in teachings of the art that various and sundry suction mechanisms such as suction rolls and suction boxes must be positioned at proper locations to insure that the web will remain stapled or adhered to the desired wire when necessary, and will be separated from one wire or belt and properly transferred to another wire or belt as necessary. The requirement for providing suction boxes or suction rolls requires additional cost and space for pumps and other ancillary parts that wear and require maintenance.

An example of prior art teaching is found in U.S. Pat. No. 3,543,834, Stuebe, which does provide a fairly compact multi-layer web former, but still requires suction roll equipment.

In U.S. Pat. No. 3,876,498, Justus, suction roll equipment is dispensed with, but adaptation for multi-ply web forming is not taught, the formed web being picked off from the inner wire or belt after the web is so thoroughly dewatered that it is no longer stapled to the inner wire but is easily removable. Therefore after the dewatered web is picked off of the inner belt, it is no longer possible to integrate it with one or more other newly formed webs to provide a multi-ply web.

SUMMARY OF THE INVENTION

An important object of the present invention is to provide substantial improvements in the twin wire forming of paper webs, and especially the simplification of apparatus and method particularly well adapted for reducing costs and improving efficiency in multi-ply web production.

Another object of this invention is to provide an improved and more economical web forming apparatus and method eliminating all need for suction rolls or suction boxes but adapted for high speed, efficient production using imperforate forming and guiding surfaces for the web carrying wires and belts.

A further object of the invention is to provide new and improved apparatus and method for effecting transfer of a newly formed web to a pickoff belt.

Still another object of the invention is to improve the forming of multi-ply paper webs.

According to features of the invention, continuous forming of a fibrous web from a slurry of stock comprises directing a stream of stock into a converging throat formed by endless foraminous outer and inner forming belts which are guided and held in tension so that the outer belt applies a pressing force against the stock within the belts in running over a forming run provided by a first convexly curved surface within the inner belt, the outer and inner belts with the forming web therebetween wrapping said surface along the forming run, the outer belt being separated by guide means from the wet web and the inner belt immediately following the forming run, the wet web then carried by the inner belt to run over a second convexly curved surface beyond the forming run, the inner belt after running for a substantial distance over the second convexly curved surface being guided by an off-running member to separate from the second curved surface while a porous pick-off belt runs toward the off-running end portion of the second curved surface, and an imperforate pickup roll presses with a substantial convex area of contact against the pickup belt and thereby against the wet web on the inner belt adjacent to but spaced from the off-running end of said second surface, the inner belt guide means guiding the inner belt divergently away from the pick-off belt commencing at the off-running end of the area of pressing contact between the contact roll and the pick-off belt, whereby the area of pressing contact of the pick-up roll squeezes air from between the area of pressing contact and the pick-off belt and the inner belt so that where the inner belt diverges from the pick-off belt the imperforate surface of the pickup roll effects a vacuum action which causes suction of air through the inner belt forcing the wet web to leave the inner belt and transfer adherently to the pickoff belt. The air pulled through the foraminous inner belt by the suction action instantaneously releases tacking of the wet web to the inner belt and substantially cleans any loose fibers from the inner belt and draws them onto the wet web. As thus transferred from the inner belt to the pickoff belt, the web is sufficiently wet for thorough union with a similarly formed web transferred to the pick-off belt downstream but conveniently adjacent to the formation of the first-mentioned web, thereby facilitating high speed multi-web formation. Web transfer to the pickoff belt may be effected either above the web forming means or below the web forming means.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

DESCRIPTION OF THE PREFERRED EMBODIMENTS

Figure 1:
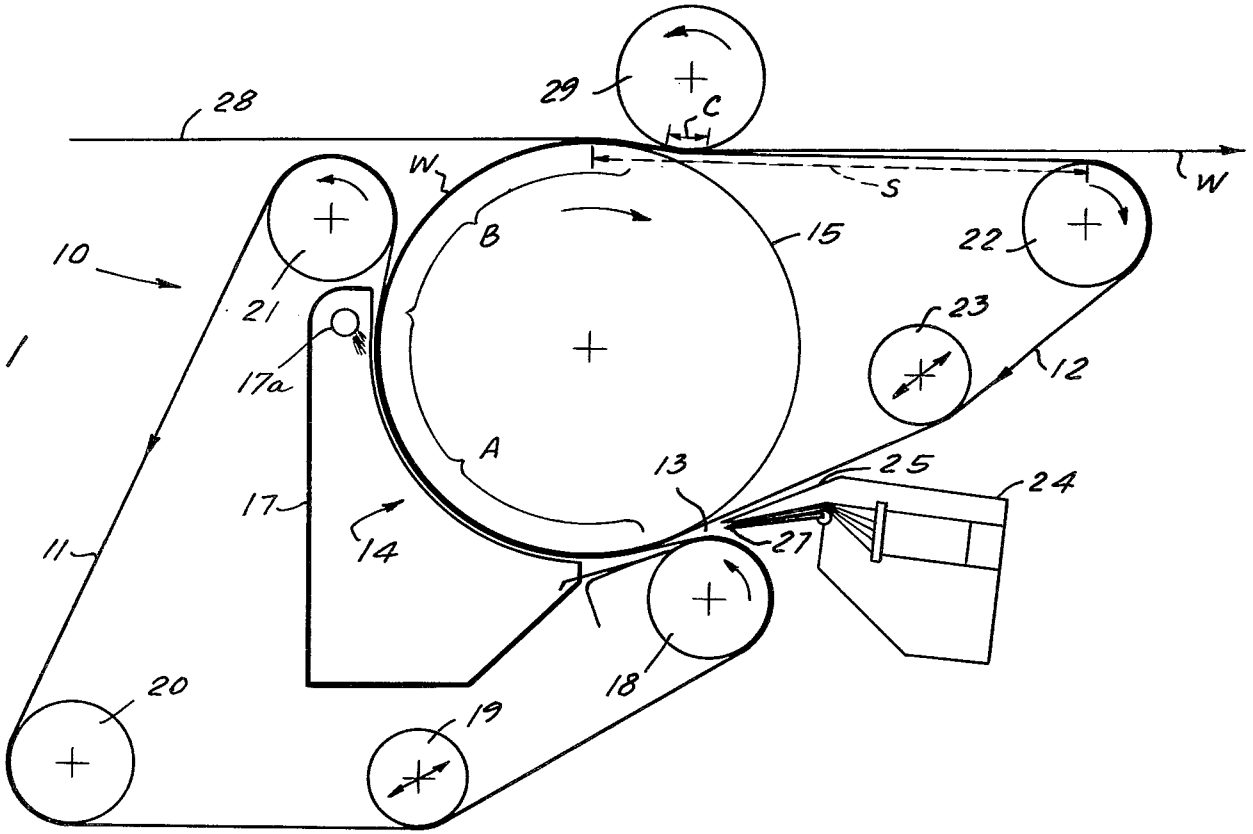
FIG. 1 is a side elevational view in generally schematic form of apparatus embodying features of the invention.

As shown in FIG. 1, a web former 10 comprises an endless foraminous outer forming belt 11 and an endless foraminous inner forming belt 12. In an especially desirable form adapted for high speed operation, the belts 11 and 12 may be woven permeable forming wires of substantially similar openness of weave best suited for the nature of the web to be formed. Desirably the belts provide substantially noncompressible and nonexpansible web support for the web to be formed therebetween. For example, the belts 11 and 12 may be especially selected to facilitate forming of tissue and toweling webs.

The forming belts 11 and 12 are positioned to form a converging throat 13 leading to a forming zone or run 14 wherein the belts wrap over a substantial arcuate perimeter surface area of a plain cylindrical forming roll 15. This roll has a large diameter smooth imperforate perimeter surface, and the belts 11 and 12 are tensioned so that they apply squeezing force normal to the web W being formed therebetween to force the water out through the outer belt 11. The water is desirably collected in a saveall 17. Near the off-running end of the forming run 14 air knife means 17*a* may be provided to assist in driving water from the outer belt 11 into the saveall 17.

Means for looped, tensioned running support of the outer belt 11 comprise a guide roll 18 adjacent to the throat 13, a tensioning roll 19, a guide roll 20, and a guide roll 21 located adjacent to the offrunning end of the forming surface area A. Means for looped, running tensioned support of the inner belt 12 comprise, in addition to the forming roll 15, a guide roll 22 and a tensioning roll 23.

For delivering papermaking stock slurry to the throat 13, a headbox 24 is provided. Stock slurry is delivered to the headbox under pressure to flow through a tapered slice chamber 25 to a slice opening 27 from which the stock slurry is delivered at the desired operating speed into the throat 13 in the running operation of the apparatus. It will be appreciated, of course, that the flow rate of the stock slurry from the slice opening 27 into the throat 13 will be properly coordinated with the coordinated speed of operation of the forming belts 11 and 12 to attain uniform web formation. From the throat 13 the forming web travels between the forming wire belts 11 and 12 along the arcuate forming surface area A of the roll 15 so that the web will be dewatered therealong and by the time the web reaches the end of the forming surface free water will have been substantially removed by virtue of the squeezing effect of the outer belt 11, and centrifugal action of the rapidly running belts and forming roll in the forming run.

By having the forming run surface A imperforate, in this instance by virtue of the perimeter of the forming roll 15 being plain and imperforate, the voids of the inner wire belt 12 will be filled with water so that the web W will be sealed or pasted onto the inner wire belt 12 as a result of the web being squeezed during the forming run. Therefore water which flows inwardly from the web fills the interstices of the inner wire belt 12. The rest of the water is squeezed out of the web and forced outwardly through the outer wire belt 11. Since the inner wire belt 12 is filled with water while the inner belt is running along the perimeter of the roll 15, fibers will not be forced inwardly to staple themselves to the inner wire belt 12. However, the surface tension of the water within the inner wire belt 12 and the sealing effect of the solid roll assures a paste-on holding effect for adherence of the forming web to the surface of the roll 15. This permits the web forming operation to proceed at very high speed such as on the order of up to 7,000 feet per minute with satisfactory long wire belt life. Nevertheless, need for suction glands or suction means are eliminated and thus the disadvantage of rubbing sealing surfaces is eliminated. The noise factor generally associated with high speeds if a perforated suction roll were used as well as the elimination of need for sealing surfaces, inertia and pressure waves, initial costs of perforated roll, driving power for suction means, wire abrasion and wear, are alleviated. The solid arcuate support for the wire belts provided in the arcuate smooth surface forming zone or area A and the lack of wire belt to roll friction in the high attainable speeds, permits other forms of arcuate support than the roll 15 to be used, such as a curved shoe.

According to the present invention, the newly formed web W while still wet enough to be efficiently joined with another newly formed wet web is rapidly transferred from the convexly curved forming surface A. To this end, the guide member 21 of the guide means for the outer wire belt 11 is positioned in off-running relation to the arcuate forming surface A immediately following the forming run of the forming belts and web to separate the outer belt 11 from the wet web W. Due to the substantially vacuum condition between the belt 12 and the wet web thereon and a second convexly curved surface B onto which they run beyond the forming run surface A, the web W is caused to remain pasted to the inner belt 12, stripping easily from the outer belt 11 which diverges from the web surface and permits air to be drawn through the diverging outer belt to force the web positively toward the belt 12 as the belt 12 and the web leave the outer belt 11. This provides for smooth, quick and easy transition of the still wet web W from the forming zone, area or run A to a porous pick-off belt 28 running substantially toward the off-running end portion of the second, curved, transition surface B. Although the length of the transition surface B is substantial in order to provide adequate clearance to accommodate the off-running outer belt 11 and the off-running guide roll 21, the distance is short enough, and the suction action of the background water in the inner wire belt 12 as it runs over the surface B is sufficient to not only retain the newly formed wet web W on the inner belt 12 against any centrifugal tendency, but also assures that the face of the web W at this time adhering to the inner belt 12 will remain substantially wet.

Figures 3, 4:
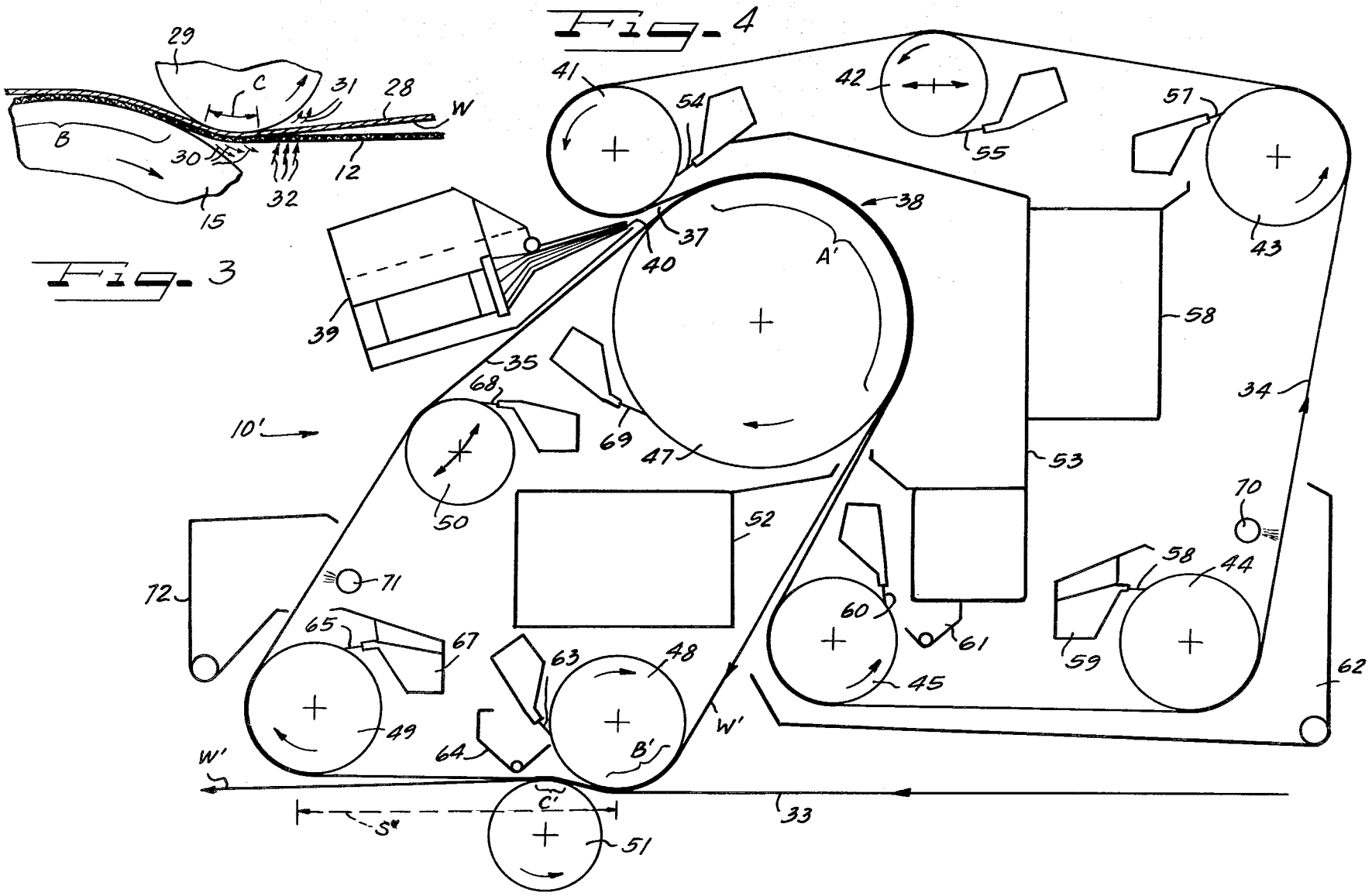
FIG. 3 is an enlarged fragmentary schematic view of a portion of the apparatus of FIG. 1 and illustrating certain principles of operation as will become clear from the description.
FIG. 4 is a schematic side elevational view of a modification of the apparatus and embodying features of the invention.

In order to transfer the wet web W from the transition surface B to the pickoff belt 28, the inner wire belt 12 is guided away from the off-running end of the transition surface B, and the still wet web W is transferred from the inner belt 12 to the confronting face of the pick-off belt. In a new and improved manner consonant with high speed operation, such transfer is effected by means of an imperforate pick-up roll 29 which engages the pick-off belt 28 adjacent to but spaced downstream in nip-free relation from the off-running end of the transition surface B and pressing with a substantial convex area of contact C (FIG. 3) against the pick-off belt 28 and thereby against the wet web W on the inner belt 12 which has been caused to separate from the off-running end of the transition surface B by the guide roll member 22 of the inner belt guide means. As shown in FIG. 1, the guide roll member 22 is spaced substantially downstream from the curved surface B so that there is a substantial free span S of the inner belt 12 between the roll member 22 and the convex surface B. Commencing at the off-running end of the area of contact C of the pick-up roll 29, the guide roll 22 guides the inner belt 12 to run divergently away from the pick-off belt at an acute angle substantially as shown. As a result of the pressing of the imperforate surface of the pick-up roll 29 against and into the outer face of the pickoff belt 28 and thereby pressing the pickoff belt 28 against the wet web W on the free span S of the inner belt 12, with sufficient indenting pressure as best visualized in FIG. 3, to assure a substantial width for the area of contact C, air squeezes out from between the area of contact C and the pickoff belt and the inner belt 12 wrapping the surface area C, as indicted by the directional arrows 30. This effectively breaks any vacuum tendency between the surface of the forming roll 15 and the inner belt 12 diverging therefrom closely adjacent to the on-running side of the pickup surface area C. At the same time the firm wrap of the pickoff belt 28 and the inner belt 12 with the wet web therebetween while running on the pickup roll surface area C and the resultant explusion of air from the wrapped belts and web squeezed therebetween, effects substantially a vacuum where the pickoff belt diverges from the off-running side of the area C and the inner belt 12 diverges from the pickoff belt with the effect of causing suction of air toward the imperforate surface of the pickup roll 29 from the pickoff belt 28, as indicated by directional arrows 31 and concurrently suction of air through the foraminous wire inner belt 12 toward the pickoff belt 28, substantially as indicted by the directional arrows 32, thereby forcing the wet web W to leave the inner belt 12 and adhere to the pickoff belt 28. Because of the speed of operation, and the substantial area of contact of the pickup roll surface C with the pickoff belt and inner belt 12 tensioned toward the surface C, and the relatively small radius of curvature of the perimeter of the roll 29, the vacuum suction action at the off-running side of the area C is forceful and strong enough to effect virtually instantaneous separation of the web W from the inner belt 12 and adherence to the pickoff belt 28. Because the web W is still fairly wet, transfer adherence to the inner face of the pickoff belt 28 is adequate to enable carrying of the web by the pickoff belt 28 for a substantial distance even where, as shown in FIGS. 1 and 3, the web is on the lower or downwardly facing surface of the pickoff belt. Furthermore, the web W still remains wet enough due to the water retained on leaving the inner belt 12 to enable efficient joining and integration with a succeeding similarly formed web to produce multi-ply paper.

Figure 2:
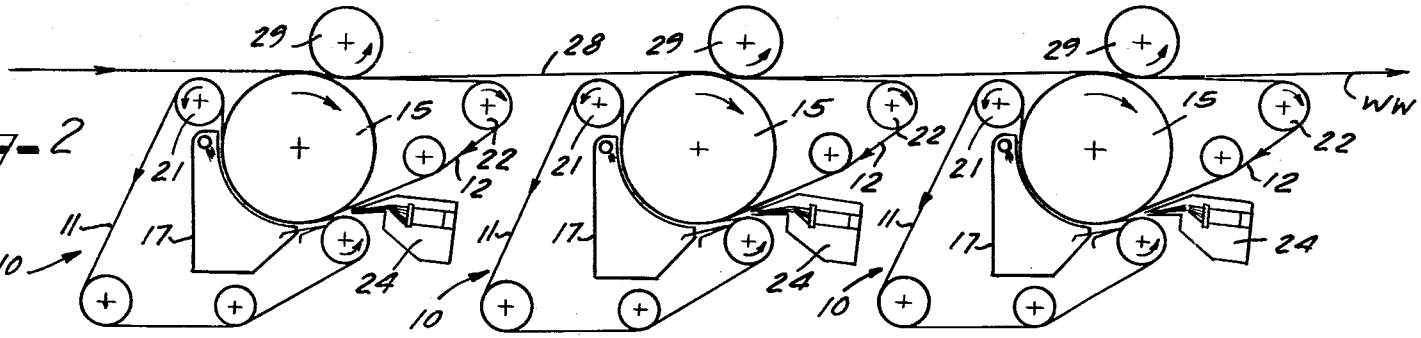
FIG. 2 is a schematic representation of a multi-ply web forming arrangement employing the web former of FIG. 1.

By way of example, in FIG. 2 a plurality of the web forming units 10 are depicted as arranged in as close as practicable series along the continuously travelling pickoff belt 28 for successive pickoff of the webs formed by each of the units 10 to construct, continuously, a multi-ply web WW. By virtue of the successively formed webs W being united face-to-face while still substantially wet, and because of the strong suction drawing of each successively freshly formed web onto the procedingly formed web at each passing of the pickoff belt 28 in running engagement with each succeeding one of the pickup rolls 29 beyond the first of such pickup rolls, tight joining of the plurality of webs is effected. Further, by reason of each of the webs W being pulled from the outer forming wire belt 11 of each of the formers 10, the surface fibers of the web faces which face toward the pickoff belt 28 efficiently in the first instance attain a good retaining grip with the porous pickoff belt 28 at the first of the formers 10. Then as the web W is pulled away from the inner belt 12 in each instance, the inner surface fibers which have assisted in pasting the forming web to the inner belt 12 are available for joining cooperation with the fibers at the outer face of the succeedingly formed and joined web W. As a result an excellent substantially homogeneous multi-ply web WW is obtained as the final product.

It will be understood, of course, that suitable supporting and driving means for the pickoff belt 28 must be provided in a suitable endless path, although not specifically shown. Furthermore, it will be understood that the pickoff belt 28 will be of the normally endless loop type to facilitate high speed web formation. Beyond the last of the web formers 10 in the series any suitable preferred means may be provided for receiving the multi-ply web WW from the pick off belt 28 for further processing such as drying, filling, calendering, and the like, as desired or required for the particular paper product being manufactured.

By way of example, in FIG. 4 is depicted a web former 10' embodying the principles of the present invention and especially adapted for web forming along a bottom running pickoff belt 33 in contrast to the top running pickoff belt 28. In the top running pickoff belt arrangement gravity drainage of excess water away from the pickoff belt permits less attention to controlling of excess water. However, in the bottom running version, more attention must be paid to this factor in order to control the integrity of the formed web, and for that reason more elaborate provision for saveall means are depicted in FIG. 4.

In a preferred form, the web former 10' comprises an endless foraminous outer forming wire belt 34 and an endless foraminous inner forming wire belt 35 which are positioned to form a converging throat 37 leading to a forming run 38 wherein the belts press against a web W' being formed therebetween. A headbox 39 has a slice opening 40 positioned to direct a stream of slurry stock into the throat 37. Means for guiding the outer belt comprise an array of guide rolls including a guide roll 41 located adjacent to the throat 37, a tensioning roll 42, a guide roll 43, a guide roll 44 and a guide roll 45. Between the guide rolls 41 and 45, the outer belt 34 is trained over a first convexly curved surface A' providing the forming run 38 within the inner belt 35 which is also trained over the surface A', whereby the outer and inner belts with the forming web therebetween wrap the surface A' along the forming run 38. Conveniently, the surface A' is provided by a rotary plain or imperforate surface forming drum or roll 47. Guide means within the endless inner forming belt 35 comprise a guide roll 48 toward which the pickoff belt 33 runs, an off-running guide roll 49, and a tensioning roll 50. In this instance, it will be observed that the guide roll 48 provides the second convexly curved surface B' providing a transfer transition run beyond the forming run 38, and over which surface B' the inner belt 35 carrying the wet web W' runs for a limited distance. As shown in FIG. 4, the guide roll member 49 is spaced substantially downstream from the curved surface B' so that there is a substantial free span S' of the inner belt 35 between the guide member 49 and the curved surface B'. In this instance the off-running guide member roll 45 for the outer belt 34 is so positioned following the forming run 38 that it effects separation of the outer belt 34 from the wet web W' which by virtue of the vacuum effect of the arcuate forming surface A' causes the wet web to remain on the inner belt 35 as the inner belt travels from the forming surface A' to the transfer transition run B' provided by the guide roll 48.

Adjacent to but spaced downstream in nip-free relation from the off-running end of the transition surface B', an imperforate pickup roll 51 engages the pickoff belt 33 and presses with a substantial convex area of contact C' against and into the pickoff belt and thereby against the wet web W' on the free span S' of the inner belt 35 to the same effect as described in connection with FIG. 3 and the pickup roll 29. As will be observed, the guide means roll 49 for the inner belt 35 operates to effect first separation of the inner belt 35 and the wet web W' carried thereby from the curved surface B' and secondly to guide the inner belt 35 to run divergently away from the pickup belt 33 commencing at the off-running end of the curved pressing contact area C' between the pickup roll 51 and the pickoff belt 33. Thereby the area of the pressing contact C' squeezes air from between such area of pressing contact and the pickoff belt 33 so that where the pickoff belt 33 diverges from the off-running side of the area C' and the inner belt diverges from the pickoff belt 33, the imperforate surface of the pickup roll 51 effects a substantially vacuum action causing suction of air through the inner belt 35 forcing the wet web to leave the inner belt and adhere to the pickoff belt 33.

For collecting waste water from the forming roll 47, a saveall 52 is provided thereunder in cooperation with a saveall 53 which generally surrounds the forming run area A' of the forming roll, in addition, various doctor blades and savealls may be associated with the various guide rolls such as a doctor blade 54 acting on the guide roll 41 immediately after it leaves the forming throat 37 and returning the water to the forming run 38. A doctor blade 55 acting on the guide roll 42 and a doctor blade 57 acting on the guide roll 43 drain into a saveall 58. A doctor blade 58 acting on the guide roll 44 drains into a saveall 59. A doctor blade 60 acting on the guide roll 45 drains into a saveall 61. In addition, a saveall 62 desirably underlies the lower portion of the loop of the outer forming belt 34. In respect to the inner forming belt 35, a doctor blade 63 acting on the guide roll 48 drains into a saveall 64, a doctor blade 65 acting on the guide roll 49 drains into a saveall 67, and a doctor blade 68 acting on the tension roll 50 drains into the saveall 52. In addition, for better control of surface water on the perimeter of the forming roll 47, a doctor blade 69 draining into the saveall 52 may be provided to act on the perimeter of the forming roll 47 upstream from the forming throat 37. For cleaning off the outer forming belt 34 to maintain optimum porosity or openness in its foramina, an air shower device 70 may be provided to blow an air shower through the belt 34 into the saveall 62. To similar effect, the foramina of the wire forming belt 35 may be kept thoroughly open by applying thereto an air shower from an air shower device 71 discharging through the belt 35 into a saveall 72.

Similarly as described for the pickoff belt 38, the pickoff belt 33 should be, for high speed operation a continuous loop trained over suitable supporting and guiding roll structure (not shown). The wet web W' produced by the former 10' may be transported by the pickoff belt 33 to one or more similar web formers to receive successive web layers to be joined together into a substantially homogeneous multi-layer web. Downstream from the last web former, the web will, of course, be separated from the pickoff belt 33 in any suitable manner and further processed into finished paper.

It will be understood that variations and modifications may be effected without departing from the spirit and scope of the novel concepts of this invention.

I claim as my invention:

1. Apparatus for continuously forming a fibrous web from a slurry of stock without any need for suction rolls or suction boxes, comprising:

an endless foraminous outer forming belt;

an endless foraminous inner forming belt;

said belts being positioned to form a converging throat leading to a forming run wherein the belts press against a web being formed therebetween;

a headbox having a slice opening positioned to direct a stream of slurry stock into said throat;

guide means within each of said endless belts holding them in tension so that the outer belt applies a pressing force against the stock within the belts in said forming run;

a first convexly curved imperforate surface providing said forming run within the inner belt, and the outer and inner belts with the forming web therebetween wrapping said surface along said forming run;

said guide means for said outer belt including an off-running member positioned following the forming run and separating the outer belt from the wet web and which wet web is maintained on the inner belt;

a second convexly curved imperforate surface providing a transfer transition run beyond said forming run and over which second surface said inner belt carrying the wet web runs for a limited distance;

said guide means for the inner belt including an off-running guide member for said inner belt spaced substantially downstream from said second curved surface so that there is a substantial free span of said inner belt between said guide member and said second surface, and operating to effect separation of the inner belt and the wet web carried thereby from said second curved surface;

a porous pickoff belt running toward the off-running end portion of said second curved surface and into pickoff engagement with the wet web;

and an imperforate rotary pickup roll engaging said pickoff belt adjacent to but spaced downstream in nip-free relation from the off-running end of said second surface and pressing with a substantial convex area of contact against and into said pickoff belt and thereby pressing said pickoff belt against the wet web on said free span of the inner belt;

said inner belt guide means member guiding said free span of the inner belt to run divergently away from said pickoff belt commencing at the off-running end of said area of pressing contact between said pickup roll and the pickoff belt and said pickoff belt diverging from the off-running side of said area;

whereby said area of pressing contact squeezes air from between said area and the pickoff belt and said wet web and said inner belt so that adjacent to the point where the pickoff belt diverges from the off-running side of said area and the inner belt diverges from the pickoff belt the imperforate surface of the pickup roll effects substantially a vacuum causing suction of air through said pickoff belt and through said inner belt toward said wet web, which suction forces the wet web to leave the inner belt and adhere to the pickoff belt.

2. Apparatus according to claim 1, wherein said first curved surface is the perimeter surface of a rotary imperforate cylindrical forming roll against which said forming belts are tensioned throughout said forming run.

3. Apparatus according to claim 2, wherein said forming roll in part supports said forming belts.

4. Apparatus according to claim 1, including saveall means positioned to receive water expressed from the forming web through said outer forming belt in said forming run.

5. Apparatus according to claim 1, wherein both of said first and second convexly curved surfaces are on the perimeter of a rotary forming roll.

6. Apparatus according to claim 5, wherein said second convexly curved surface is over a limited extent of the perimeter of the forming roll just sufficient to provide clearance between the off-running member of the guide means for the outer belt and the on-running position of the pickoff belt.

7. Apparatus according to claim 1, wherein the off-running member of the guide means for the outer belt, and the off-running guide member for the guide means for the inner belt both comprise guide rolls.

8. Apparatus according to claim 1, wherein both of said outer forming belt and said inner forming belt comprise woven wire belts.

9. Apparatus according to claim 1, wherein the apparatus as defined comprises a single web former, and at least one additional similar web former positioned to add another wet web to the wet web adhering to the pickoff belt to form a multi-ply web.

10. Apparatus according to claim 1, wherein said first convexly curved surface is on an imperforate forming roll and second convexly curved surface is on an imperforate guide roll for said inner forming belt and spaced from said forming roll.

11. Apparatus for continuously forming a fibrous web from a slurry of stock without any need for suction rolls or suction boxes, comprising:

an endless foraminous outer forming belt:

an endless foraminous inner forming belt;

said belts being positioned to form a converging throat leading to a forming run wherein the belts press against a web being formed therebetween.

a headbox having a slice opening positioned to direct a stream of slurry stock into said throat;

in tension so that the outer belt applies a pressing force against the stock within the belts in said forming run:

an imperforate rotary forming roll providing a first convexly curved surface providing said forming run within said inner belt, and the outer and inner belts with the forming web therebetween wrapping said surface along said forming run;

said guide means for said outer belt including an off-running member positioned immediately following the forming run and separating the outer belt from the wet web and which wet web remains on the inner belt;

a second convexly curved surface on said forming roll continuing beyond said forming run surface and providing a transfer transition run over which said inner belt carrying the wet web runs for a limited distance.

said guide means for the inner belt including an off-running guide member for said inner belt spaced substantially downstream from said second curved surface so that there is a substantial free span of said inner belt between said guide member and said second surface, and operating to effect separation of the inner belt and the wet web carried thereby from said second curved surface of the forming roll;

a porous pickoff belt running toward the off-running end portion of said second curved surface and into pickoff engagement with the web web;

an imperforate convex pickup surface engaging said pickoff belt adjacent to but spaced downstream in nip-free relation from the off-running end of said second surface and pressing with a substantial convex area of contact against and into said pickoff belt and thereby pressing said pickoff belt against the wet web on said free span of the inner belt;

said inner belt guide means member guiding said free span of the inner belt to run divergently away from said pickoff belt commencing at the off-running end of said area of pressing contact between said convex surface and the pickoff belt and said pickoff belt diverging from the off-running side of said area;

whereby said area of pressing contact squeezes air from between said area and the pickoff belt and said wet web and said inner belt so that adjacent to the point where the pickoff belt diverges from the off-running side of said area and the inner belt diverges from the pickoff belt the imperforate surface of the convex surface effects substantially a vacuum causing suction of air through said pickoff belt and through said inner belt toward said wet web, which suction forces the wet web to leave the inner belt and adhere to the pickoff belt.

12. Apparatus according to claim 11, wherein said apparatus as defined comprises a single web former, and at least one additional similar web former provided in a downstream direction for transferring another wet web to the wet web carried by the pickoff belt whereby to provide a multi-layer composite web.

13. Apparatus according to claim 11, wherein said guide means for the outer forming belt comprises three supporting and guide rolls and a tensioning roll, and the guide means for the inner forming belt comprises a single guide roll comprising said off-running guide member and a tensioning roll, the inner belt being otherwise supported by said forming roll.

14. Apparatus for continuously forming a fibrous web from a slurry of stock, comprising:

an endless foraminous outer forming belt;

an endless foraminous inner forming belt;

said belts being positioned to form a converging throat leading to a forming run wherein the belts press against a web being formed therebetween;

a headbox having a slice opening positioned to direct a stream of slurry stock into said throat;

guide means within each of said endless belts holding them in tension so that the outer belt applies a pressing force against the stock within the belts in said forming run;

a rotary forming roll providing a first convexly curved surface providing said forming run within said inner belt, and the outer and inner belts with the forming web therebetween wrapping said surface along said forming run;

said guide means for said outer belt including an off-running member positioned immediately following the forming run and separating the outer belt from the wet web and which wet web remains on the inner belt;

a second convexly curved surface on said forming roll continuing beyond said forming run surface and providing a transfer transition run over which said inner belt carrying the wet web runs for a limited distance;

said guide means for the inner belt including an off-running guide member for said inner belt and operating to effect separation of the inner belt and the wet web carried thereby from said second curved surface of the forming roll;

a porous pickoff belt running toward the off-running end portion of said second curved surface and into pickoff engagement with the wet web;

means immediately adjacent to said off-running end portion of said second curved surface and cooperating with said pickoff belt to effect positive transfer of the wet web from said inner forming belt onto said pickoff belt;

said inner belt guide means member guiding the inner belt to run divergently away from said pickoff belt;

said pickoff belt contacting the forming roll at the top of the roll and said forming run being generally along a lower portion of the roll;

and a saveall located to receive water expressed from the forming web along said forming run, and water draining below said forming roll.

15. A method of continuously forming a fibrous web from a slurry of stock without any need for suction roll means or suction box means, comprising:

directing a stream of slurry of stock into a converging throat leading to a forming run between endless foraminous inner and outer forming belts held under tension to apply a pressing force against the stock within the belts running over a first imperforate convexly curved surface providing the forming run within the inner of the belts;

separating the outer belt from the wet web and maintaining the wet web on the inner belt;

running the inner belt carrying the wet web for a limited distance over a second imperforate convexly curved surface providing a transfer transition run beyond said forming run;

guiding the inner belt to separate the inner belt and the wet web carried thereby from the second curved surface on a free span of said inner belt diverging from said second surface;

running a porous pickoff belt toward the off-running end portion of the second curved surface and into pickoff engagement with the wet web on said inner belt;

engaging a substantial convex area of an imperforate rotary pickup roll into corunning engagement with the pickoff belt adjacent to but spaced downstream in nip-free relation from the off-running end of said second surface and pressing said convex area into contact with substantial pressure against the pickoff belt and thereby deflecting the pickoff belt and the free span of the inner belt a limited distance toward said second surface and squeezing the wet web tightly between said pickoff belt and the inner belt;

guiding the inner belt to run divergently away from said pickoff belt commencing at the off-running end of the area of pressing contact between the pickup roll and the pickoff belt.

squeezing air from between said area of pressing contact and the pickoff belt and web and the inner belt;

and effecting a vacuum between the corunning pickup roll and the offrunning portion of the pickup belt and causing suction of air through said pickup belt and said web and said inner belt and forcing the wet web to leave the inner belt and adhere to the pickoff belt adjacent to the point where the pickoff belt diverges from the off-running side of said area of pressing contact and the inner belt diverges from the pickoff belt.

16. A method according to claim 15, comprising transferring at least one additional wet web into union with said wet web adhering to the pickoff belt, and thereby forming a multi-ply web.

17. A method according to claim 15, comprising running the pickoff belt below said inner and outer forming belts, and directing the inner forming belt downwardly toward the pickoff belt for effecting transfer of the web to the pickoff belt.

18. A method according to claim 17, comprising collecting substantially all waste water from the vicinity of the forming belts in savealls to substantially prevent dropping of the water onto the pickoff belt.

19. A method of continuously forming a fibrous web from a slurry of stock, comprising:

directing a stream of slurry stock into a converging throat inner and outer forming belts held under tension to apply a pressing force against the stock within the belts running over a first convexly curved surface providing the forming run within the inner of the belts;

separating the outer belt from the wet web and maintaining the wet web on the inner belt;

running the inner belt carrying the wet web for a limited distance over a second convexly curved surface providing a transfer transition run beyond said forming run;

guiding the inner belt to separate the inner belt and the wet web carried thereby from the second curved surface;

running a porous pickoff belt toward the off-running end portion of the second curved surface and into pickoff engagement with the wet web;

engaging a substantial convex area of an imperforate rotary roll into engagement with the pickoff belt adjacent to but spaced downstream in nip-free relation from the off-running end of said second surface and pressing said convex area into contact with substantial pressure against the pickoff belt and thereby against the wet web and the inner belt;

guiding the inner belt to run divergently away from said pickoff belt commencing at the off-running end of the area of pressing contact between the pickup roll and the pickoff belt;

the pickoff belt and the inner belt; effecting a vacuum and causing suction of air through said inner belt and forcing the wet web to leave the inner belt and adhere to the pickoff belt adjacent to the point where the pickoff belt diverges from the off-running side of said area of pressing contact and the inner belt diverges from the pickoff belt;

said first and second convexly curved surfaces both being on and immediately succeeding one another on the perimeter of a rotary forming roll, and running said pickoff belt above both the inner and outer forming belts;

and directing the inner and outer forming belts downwardly away from the pickoff belt after separating the outer belt from the inner belt and wet web and after separating the inner belt from the pickoff belt.

* * * * *